United States Patent [19]

Daily

[11] Patent Number: 4,644,135

[45] Date of Patent: Feb. 17, 1987

[54] WALL MOUNTED FORCED AIR ELECTRIC HEATER

[75] Inventor: Terrill A. Daily, Richardson, Tex.

[73] Assignee: The Marley Company, Mission Woods, Kans.

[21] Appl. No.: 527,534

[22] Filed: Aug. 29, 1983

[51] Int. Cl.[4] ..... F24H 3/04; F04D 1/14

[52] U.S. Cl. ..... 219/370; 219/373; 415/204; 415/206

[58] Field of Search ..... 415/204, 206; 219/368, 219/369, 370, 371, 373, 374, 366

[56] References Cited

U.S. PATENT DOCUMENTS

| | | | |
|---|---|---|---|
| 999,241 | 8/1911 | Mies | 219/366 |
| 1,288,506 | 12/1918 | Carmean | 219/370 |
| 1,484,055 | 2/1924 | Beugler | 415/206 |
| 1,650,873 | 11/1927 | Kay | 415/206 |
| 2,135,827 | 11/1938 | Marty | 415/206 |
| 2,449,755 | 9/1948 | Taylor | 219/368 |
| 2,471,784 | 5/1949 | Seifner | 219/370 |
| 2,528,650 | 11/1950 | Graham | 219/374 |
| 2,651,705 | 9/1953 | Clemens | 219/368 |
| 2,724,044 | 11/1955 | Campbell | 219/374 |
| 2,976,352 | 3/1961 | Atalla | 415/206 |
| 3,020,384 | 2/1962 | Murphy | 219/368 |
| 3,111,573 | 11/1963 | Crowe et al. | 219/374 |
| 3,263,749 | 8/1966 | Dormitzer | 219/369 |
| 3,674,980 | 7/1972 | Cox | 219/368 |
| 3,939,850 | 2/1976 | Wahl | 219/368 |
| 4,225,775 | 9/1980 | Carter | 219/370 |
| 4,471,213 | 9/1984 | Yoshida | 219/374 |

*Primary Examiner*—A. D. Pellinen
*Assistant Examiner*—Geoffrey S. Evans
*Attorney, Agent, or Firm*—Steve Litchfield

[57] ABSTRACT

An archimedic or logarithmic scroll is used with an axial fan to provide a smooth and relatively quiet air flow over the electric heating elements. Additionally a lip 21 is mounted at the air outlet to prevent heated air from being drawn back through the axial fan.

8 Claims, 5 Drawing Figures

WALL MOUNTED FORCED AIR ELECTRIC HEATER

BACKGROUND OF THE INVENTION

This invention relates in general to electric heaters and in particular to electric heaters designed to be wall mounted.

Conventionally, electric heaters have been of either the axial fan or blower type. The blower type has utilized a scroll arrangement in combination with the blower wheel to push air in the radial direction of the blower wheel. The fan type heaters have been used in the past to direct air axially through the fan blades. The blower is an air moving device having performance characteristics that depend not only on the blower wheel, but also, and to an important degree, on the scroll shaped housing containing the wheel. The fan is an air moving device with performance characteristics that depend on the impeller alone or the impeller in combination with the cylindrical shaped housing.

Blower designs utilize an elongated wheel having blades arranged generally parallel to the axis of the wheel. The blower, in combination with the scroll, operates such that the scroll guides air into the heel of the blower with as little turbulance, friction and air loss as possible. Further, the scroll collects air from the wheel periphery and with a minimum of recirculation directs it to a single outlet. By using a scroll design of the archimedic and logarithmic types, the space between the wheel and the housing progressively increases, thereby converting some of the velocity pressure developed by the wheel into static pressure as the air is pushed radially around the scroll by the blower wheel. The use of the archimedic or logarithmic spiral as a basis for the scroll design is well-known when used in combination with a blower assembly. In the blower design, the spiral is continued from below the horizontal centerline of the wheel around the wheel and well past the intersection of the vertical center line of the wheel. When used in a heating apparatus, the blower must be in relationship to the heating elements so as to cause the air moved by the blower to pass through the elements and be warmed. Devices of this type are generally large and have not been well suited for wall mounting, particularly in residential wall mounting applications where it is desirable for the heater to mount between standard sized building joists or studs.

For fan type heaters, since air is drawn and propelled axially through the blades in a direction generally parallel to the axis of the fan, the heating elements must be arranged in front of the air flow generated by the fan blades for efficient operation. Also, there must be a free flow of air through the fan. In a wall mounted application, the axial fan is at a disadvantage since the rearward end of the fan is generally closed off. Also, the need to arrange the heating elements in front of the air flow has required the use of a large heater apparatus. To slim the axial fan heater, air circulation becomes a problem requiring the air to be moved in a number of different directions thereby creating operating noise. Thus, it has been difficult to utilize a fan type heater in a wall mounted application.

There is a need in the field for an improved heater assembly capable of wall mounting for providing a smooth air flow through the heating elements with little or no back pressure and little or no recirculation. Also there is a need in the field for a heater mountable between standard sized joists or studs in a residential construction. Further, there is a need for a wall mountable heater capable of drawing a sufficient amount of air from the surroundings and of generating a large capacity of heated air into a room. There is also a need in the field for a wall mountable electric heater apparatus which will operate with comparatively little noise.

SUMMARY OF THE INVENTION

It is an object of this invention to provide an electric heater apparatus capable of mounting in a wall adjacent the joists of a typical home construction.

It is a further object of this invention to provide an electric heater apparatus utilizing the advantages of the conventional blower design and the advantages of conventional fan design to create a wall mountable heater having a smooth and relatively quiet air flow with little or no recirculation of air.

It is an additional object of the invention to provide a wall mountable heater capable of generating sufficient BTU per hour to heat a substantial living area in a residence.

Further objects and advantages of the invention will, in part, become apparent as the following description proceeds. The features of novelty which characterize the invention will be pointed out with particularity in the claims annexed to and forming a part of this specification.

The invention comprises a wall mountable heater having a housing in which is rotatably mounted an axial fan, a motor for rotating the fan, an air passageway including a scroll covering a portion of the fan where said scroll follows in substantial detail the archimedic or logarithmic spiral, a heating element disposed adjacent the bottom of the scroll and fan, a bottom cover having means for directing air outwardly from the heater, said bottom cover attached to the housing such that it covers the lower portion of the fan and scroll and heating element, and a back cover or back can covering the back of the assembly in its entirety. Also, a decorative front cover is attached to the front of the housing assembly, covering the fan. A thermostat can be included in the assembly to control the operation of the heater. When so assembled, the fan will draw air axially through its blades from the room into the scroll area. The air is circulated around the spiral of the scroll through the air passageway where it passes over the heating elements and is forced out into the room. The scroll follows generally the archimedic or logarithmic spiral and is designed to fit the size of the heating unit to enable the entire unit to fit between standard joists in a typical home construction.

In the best mode, the scroll is of a continuous curve along the spiral and as such reduces the noise generated by the air circulating through the fan. As a matter of general application in air movement, when air changes direction, it generates noise. By having a continuing curved scroll design, there is very little noise generated in the operation of the unit. Further, the scroll smoothes the air flow and reduces back pressure in the device. A lip is provided between the exhaust area of the air passageway and the decorative front cover. This lip prevents the heated air from recirculating through the system. By using the axial fan in combination with the scroll, the unit is kept slimmer than possible with a traditional blower or fan arrangement, thereby enabling it to be wall mounted between standard sized joists in a residential application.

BRIEF DESCRIPTION OF THE DRAWINGS

The features of the present invention, which are believed to be novel, are set forth with particularity in the appended claims. The invention, together with further objects and advantages, may best be understood by reference to the following description taken in conjunction with the accompanying drawings, and several figures, of which like reference numerals identify like elements and in which:

DETAILED DESCRIPTION

Figure 1:
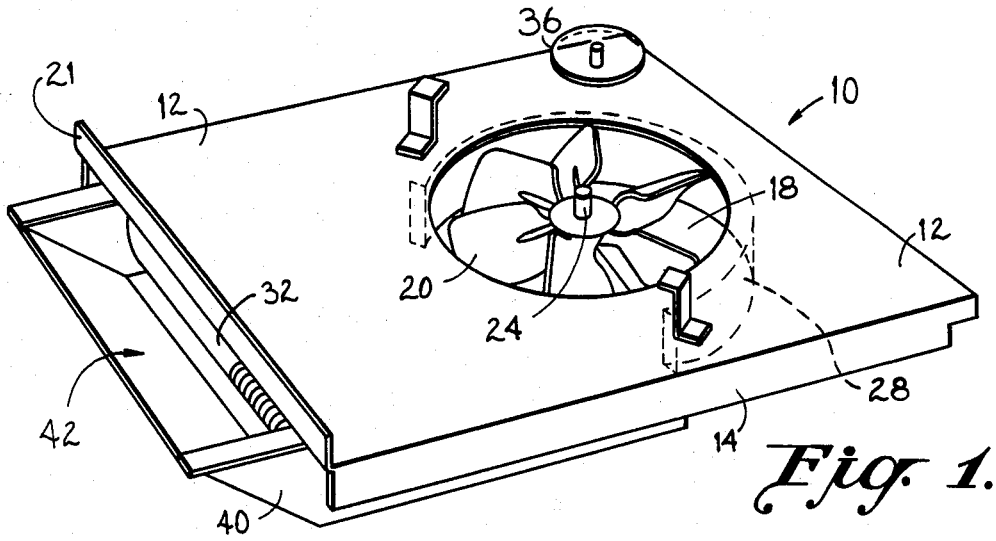
FIG. 1 is a front perspective view of the electric heater apparatus without the front decorative cover.
Figure 2:
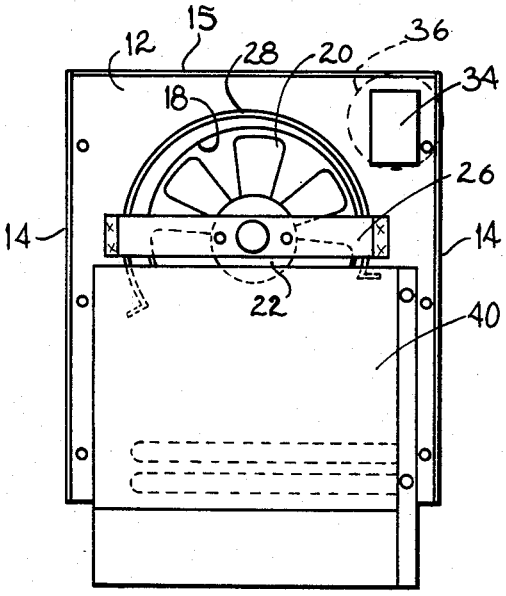
FIG. 2 is a back view of the heater apparatus with the bottom cover in place.

Referring to the drawings, a heater assembly in accordance with the invention is identified generally at 10 in FIG. 1. Referring to FIG. 1 heater assembly 10 comprises axial fan 20 mounted in opening 18 in shroud 12. Fan 20 is attached to motor shaft 24 for rotational movement within opening 18 of shroud 12. Referring to FIG. 2, heater assembly 10 has bottom cover 40 mounted to shroud 12 such that it covers the lower portion of fan 20 and shroud 12. Bottom cover 40 forms the back of air passageway 35 shown in FIG. 3.

Figure 3:
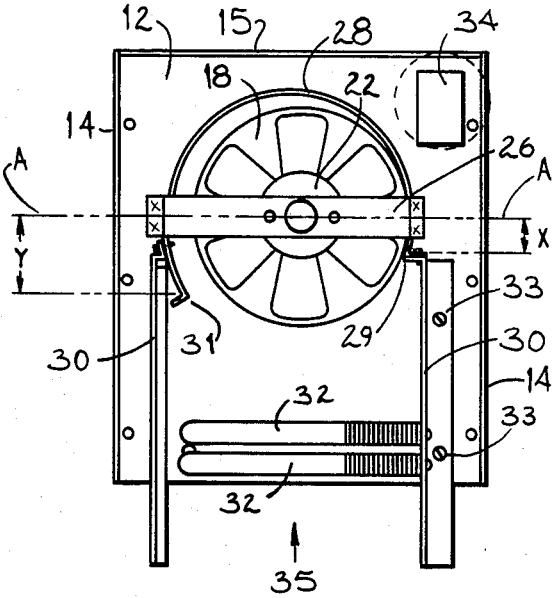
FIG. 3 is a back view of the heater apparatus without the bottom cover in place.
Figure 4:
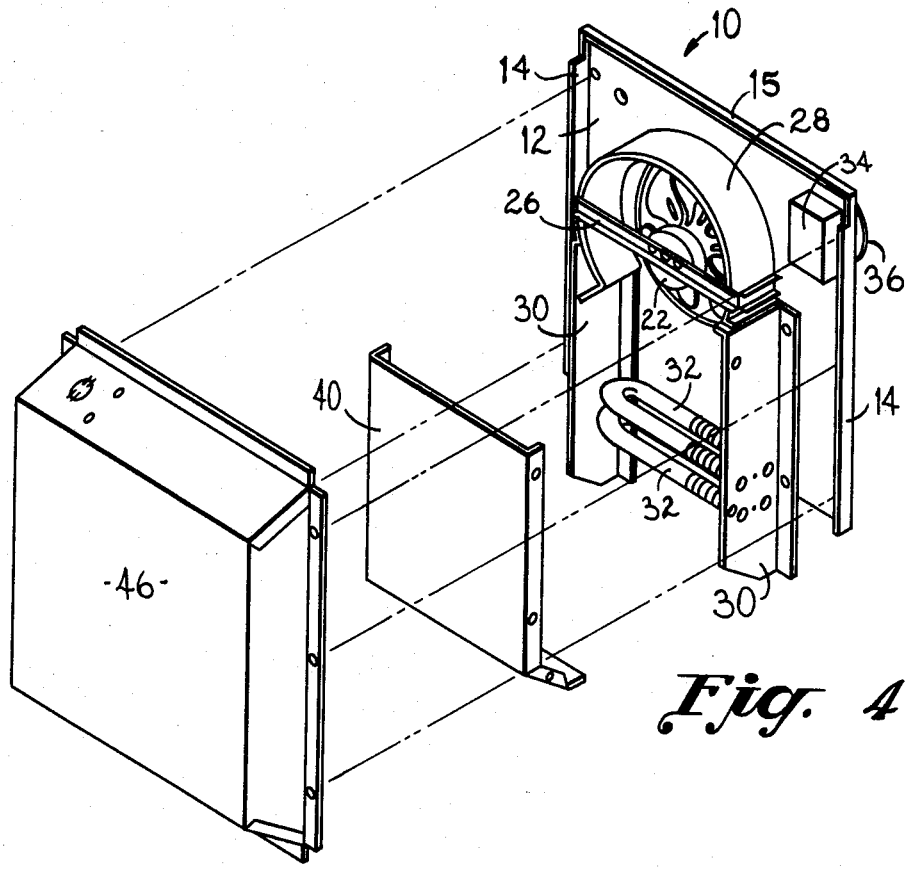
FIG. 4 is a back perspective view of the heater apparatus with the back can and bottom cover exploded.
Figure 5:
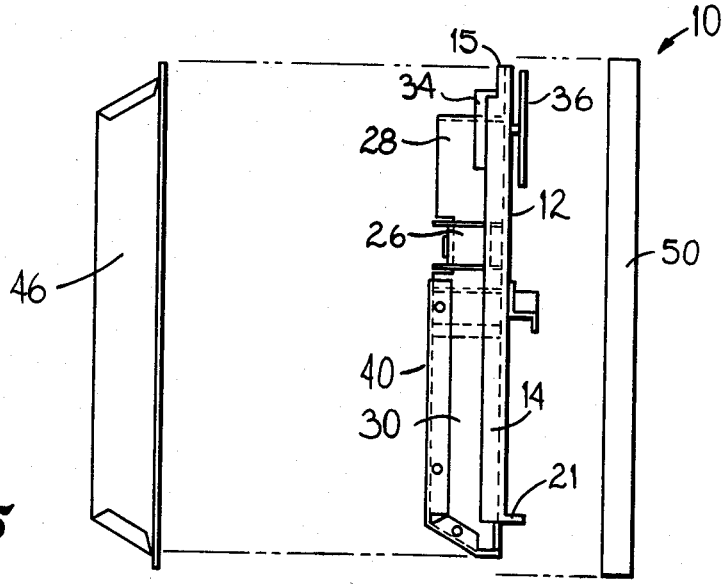
FIG. 5 is a side view of the heater apparatus with the bottom cover, back can and front cover exploded.

As seen in FIG. 3, heating elements 32 are disposed beneath opening 18 of shroud 12 and adjacent side panels 30. Side panels 30 are arranged generally normal to shroud 12 and are connected to shroud 12 by screws 33. Scroll 28 is attached to shroud 12 and is disposed around opening 18 as shown. Side panels 30 connect adjacent the ends of scroll 28 forming an air flow passageway 35 over elements 32. In FIG. 3, electric motor 22 is mounted to motor mount 26 which is in turn mounted to shroud 12. Shroud 12 further has thermostat 34 with thermostat control knob 36 mounted thereto. Bottom cover 40 is connected to side panels 30 to form the cover over air flow passageway 35. Bottom cover 40 is angled at its bottom end to form exhaust opening 42 shown in FIG. 1. This exhaust opening 42 directs the air flow downward and outward across the room after the air has been warmed by heating elements 32. As best seen in FIGS. 4 and 5, back can 46 assembles with flanges 14 on shroud 12 to provide a totally enclosed compartment for the heater assembly 10.

Fan 20 is of the axial type. In a typical application, the axial fan 20 has 6 metal blades, each approximately 3½ inches wide, 2¾ inches long, with a 2½ inch pitch, and a 7 5/16 inch diameter overall. The shroud 12 is comprised of a planar piece of sheet steel approximately 0.030 inches thick with half inch side flanges 14 and a 5/16 inch flange 15 on its top edge. Opening 18 is 8 3/8 inches in diameter. The bottom cover 40 and back can 46 are comprised of sheet steel of approximately 0.030 inch thickness. By so designing the dimensions of the shroud and other components, the heater assembly 10 can fit between standard wall studs used in the home construction which generally are 16 inches measured from the center. This is accomplished by bolting or screwing the back can 46 at flanges 48 to the wall studs (not shown). Once the shroud 12, with assembled components thereon, is bolted to the installed back can 46, a decorative front cover 50 (shown in FIG. 5) may be secured over the shroud 12 covering the heater assembly 10.

The motor 22 is a standard electric motor capable of rotating the axial fan 20 from 1200 to 1500 rpm. In a typical application, motor 22 is of the four pole type. By varying the motor capacity and the size of the fan blades, the heating capacity of the invention can range from 5100 BTU/hour output to 17,000 BTU/hour output. In a kilowatt rating, the heater will range from 2500 to 5000 wattage.

It should be noted that the above materials and dimensions can be varied to produce varied results for different applications. Also, other materials can be substituted for those mentioned above and still provide a workable heater within the scope of the invention claimed.

Shroud 12 has lip 21 spaced between the front cover 50 and the shroud 12, which prevents the recirculation of air from the exhaust opening 42 back through the axial fan 20. Scroll 28 is of the archimedic or logarithmic type. The scroll shown is based on the archimedic spiral which has an even, linear expansion between the fan and housing. The expansion of scroll 28 is approximately uniform from point 29 as seen on FIG. 3 to point 31. The difference between distance X on center line A and distance Y on center line A forms a critical design and operational aspect of the heater. Distance Y is greater than distance X showing that the nature of the angle formed between point 29 of scroll 28 and the center point of the fan, with respect to center line A.

The heating element 32 is of the electrical resistance type. In a typical application of the present invention it embodies a steel, tubular sheath filament having helical fins with resistance wire, insulated by compressed magnesium oxide; commonly called the closed type of heating element. Also, the coiled, electrical resistance heating wire may be used as the heating element 32; commonly called the open type.

Again, it should be realized that variations may be made in the scroll design and in the heating elements and still be within the scope of the invention as claimed.

In operation, axial fan 20 draws air axially through its blades from the room and through opening 18 of shroud 12 where the air is circulated along the contours of scroll 28. This air is propelled downward over elements 32 and outward through exhaust opening 42. When the front cover is placed over shroud 12, lip 21 prevents the heated air exiting from exhaust opening 42 from being drawn back through axial fan 20. This prevents recirculation of heated air and helps ensure that all of the heated air is propelled into the room. Since the scroll 28 is of a continuously expanding curve based on the archimedic spiral, there is relatively little noise generated by operation of the fan. Air movement is smoothly translated from the axial direction by the fan 20 around the scroll 28 and out the exhaust opening 42. Thus, a very compact and slim wall mountable heater is developed by the assembly of the above-mentioned elements, since the fan turns in a plane parallel to the shroud 12 and wall. The depth of the heater assembly 10 comprises only that necessary to form the air passageway 35 between scroll 28, side panels 30, and bottom cover 40. In typical application, it has been found that the depth of the heater assembly 10 will be less than 4 inches.

Thus, it is apparent that there has been provided in accordance with the invention an electric heater assembly that fully satisfies the objects, aims, and advantages set forth above. The electric heater disclosed axially collects air with little recirculation, little back pressure, and with little turbulence. By combining the archimedic or logarithmic scroll design with the axial fan, an electric heater is provided which moves more heated air per minute and utilizes much smaller components than traditional heaters.

While the invention has been described in conjunction with a specific embodiment, it is evident that many alternatives, modifications, and variations will be apparent to those skilled in the art in light of the foregoing description. Accordingly, it is intended to embrace all such alternatives, modifications, and variations as fall within the spirit and scope of the appended claims.

I claim:

1. A heating apparatus comprising a housing defining an air passageway and having a fan rotatably mounted therein for axially drawing air into said passageway, said housing having a scroll mounted therein, said scroll surrounding a portion of the fan and forming a part of the air passageway, said scroll being of an archimedic design; said scroll having two ends, one said end closely adjacent the fan and the other said end removed from the fan, said ends positioned with respect to a line drawn through the center of the fan and normal to the projected air flow of the fan, such that both ends are on the same side of the line in the direction of the projected air flow and the removed end is a substantially greater distance from said line than the adjacent end; each said scroll end immediately adjacent and connected to an interior wall of the passageway such that the distance between the scroll ends substantially equals the width of the passageway, means for heating air disposed adjacent said scroll in said passageway, motor means mounted in said housing for rotating said fan about its axis and cover means for covering the air passageway and for directing heated air out of the apparatus, means for preventing the heated air from recirculating through the heating elements comprising a lip formed on said housing between the fan and the means for directing heated air out of the apparatus, adjacent said air direction means and a front cover plate mounted to the housing over the lip.

2. The heating apparatus of claim 1 where the air passageway is normal to axial air flow through the fan.

3. The heating apparatus of claim 1 where said air heating means comprises electrical resistance wire.

4. The electrical heating apparatus of claim 1 where said motor means comprises an electric motor having a rotary shaft upon which said fan is mounted.

5. The heating apparatus of claim 1 further comprising means for controlling the extent and duration of operation of the apparatus.

6. An electric heating apparatus comprising a planar shroud having a substantially circular opening therein, a fan mounted adjacent said opening such that the axis of rotation of said fan is substantially normal to the plane of the shroud, a means for rotating said fan and means for mounting said rotation means to said shroud, a scroll of an archimedic design mounted around a portion of the opening, a pair of side covers mounted substantially normal to the shroud each said cover disposed adjacent an end of the scroll and defining an air passageway with said scroll, said scroll having two ends, one said end closely adjacent the fan and the other said end removed from the fan, said ends positioned with respect to a line drawn through the center of the fan and normal to the projected air flow of the fan, such that both ends are on the same side of the line and the removed end is a substantially greater distance from said line than the adjacent end; each said scroll end immediately adjacent and connected to an interior wall of the passageway such that the distance between the scroll ends substantially equals the width of the passageway, means for heating air disposed in said air passageway, means for preventing the heated air from recirculating through the heating elements comprising a lip formed on said housing between the fan and the means for directing heated air out of the apparatus adjacent said air direction means, a front cover plate mounted to the housing over the lip, and means for covering the air passageway.

7. The heating apparatus of claim 6 where the air passageway includes means for directing the heated air away from the heating apparatus.

8. The heating apparatus of claim 6 including means for controlling the duration of the operation of the heating apparatus.

* * * * *